US008006337B2

(12) United States Patent
Birmingham et al.

(10) Patent No.: US 8,006,337 B2
(45) Date of Patent: Aug. 30, 2011

(54) CREW TRANSFER SYSTEM

(75) Inventors: Lily T. Birmingham, Laurel, MD (US); Corey A. Fleischer, Columbia, MD (US); Alexander C. Boon, Baltimore, MD (US); Kevin Quinn, Brooklyn, MD (US)

(73) Assignee: Lockheed Martin Corporation, Bethesda, MD (US)

( * ) Notice: Subject to any disclaimer, the term of this patent is extended or adjusted under 35 U.S.C. 154(b) by 77 days.

(21) Appl. No.: 12/370,261

(22) Filed: Feb. 12, 2009

(65) Prior Publication Data

US 2009/0199354 A1 Aug. 13, 2009

Related U.S. Application Data

(60) Provisional application No. 61/028,161, filed on Feb. 12, 2008.

(51) Int. Cl.
*E01D 1/00* (2006.01)

(52) U.S. Cl. ..... 14/71.1; 14/69.5; 114/362

(58) Field of Classification Search ..... 14/69.5–71.5; 404/69.5–71.5; 182/48
See application file for complete search history.

(56) References Cited

U.S. PATENT DOCUMENTS

| | | | | |
|---|---|---|---|---|
| 2,641,785 | A * | 6/1953 | Pitts et al. | 14/71.1 |
| 2,803,841 | A | 8/1957 | Wellens | |
| 4,011,615 | A * | 3/1977 | Maxson et al. | 14/71.1 |
| 4,083,072 | A * | 4/1978 | Ryan | 14/69.5 |
| 4,133,283 | A * | 1/1979 | Ryan | 114/230.18 |
| 4,228,582 | A * | 10/1980 | Arai | 29/650 |
| 4,366,591 | A * | 1/1983 | Zimmerman | 14/71.3 |
| 5,135,076 | A * | 8/1992 | Su | 182/48 |
| 6,347,424 | B1 * | 2/2002 | Vatne | 14/69.5 |
| 6,955,134 | B2 * | 10/2005 | Prins | 114/230.17 |
| 7,331,302 | B2 * | 2/2008 | Secretan et al. | 114/117 |
| 2010/0032543 | A1 * | 2/2010 | Van Der Tempel et al. | 248/550 |

FOREIGN PATENT DOCUMENTS

| | | | |
|---|---|---|---|
| FR | 2465640 | | 3/1981 |
| FR | 2586641 | * | 6/1987 |
| GB | 2246992 | A | 2/1992 |
| NL | 7203341 | A | 9/1973 |
| SU | 610718 | * | 9/1975 |

OTHER PUBLICATIONS

Translation of FR 2,465,640 A1 Alain Bouigaran Mar. 27, 1981, in its entirety.*

Addie, Raymond W., "U.S. Appl. No. 12/491,969 Office Action Dec. 17, 2010", , Publisher: USPTO, Published in: US.

Raffaelli, Leonardo, "PCT Application No. PCT/US2009/033952 International Search Report Apr. 8, 2010", , Publisher: PCT, Published in: PCT.

Raffaelli, Leonardo, "PCT Application No. PCT/US2009/033952 Aug. 13, 2010", , Publisher: PCT, Published in: PCT.

Addie, Raymond W., "U.S. Appl. No. 12/550,003 Office Action Oct. 6, 2010", , Publisher: USPTO, Published in: US.

Deschanel, Sylvain, "AU Application No. 2009214641 Office Action Feb. 16, 2011", Publisher: IPA, Published in: AU.

* cited by examiner

*Primary Examiner* — Raymond W Addie
(74) *Attorney, Agent, or Firm* — DeMont & Breyer, LLC

(57) ABSTRACT

A crew transfer system for transferring personnel from a vessel to a stationary platform, such as an oil rig, is disclosed. In the illustrative embodiment, the system includes a ramp that is coupled to the vessel in such a way as to permit one translational and three rotational degrees of freedom at the vessel-end of the ramp. When the ramp couples to the stationary platform, the coupling permits no translational and only two rotational degrees of freedom.

17 Claims, 5 Drawing Sheets

CREW TRANSFER SYSTEM

This case claims priority of U.S. Provisional Patent Application U.S. 61/028,161, which was filed on Feb. 12, 2008 and is incorporated herein by reference.

FIELD OF THE INVENTION

The present invention relates to a system suitable for transporting personnel between a sea-faring vessel and a stationary or quasi-stationary platform, such as an oil rig, in high sea states.

BACKGROUND OF THE INVENTION

Safely and efficiently transporting personnel to oil platforms in the open ocean is a formidable challenge. In particular, wave heights of two to three meters and thirty-knot winds are not uncommon. In these conditions, transfer vessels experience pronounced heaving, pitching, and rolling motions, especially when they are at zero forward speed.

Traditionally, crews have been transferred to an oil rig via a crane-and-basket method or using a basket that is deployed from a helicopter. In the former method, personnel being transferred from a vessel step into or hang on to a basket that is suspended from a rig-mounted crane. The crane then hoists the basket and swings it over to the rig. In the latter technique, personnel are lowered from a helicopter on to the rig via a basket.

Used for the decades, both of these personnel-transfer methods involve certain risks. The usual accidents include lateral impacts, falling, hard landings, and water immersion.

Furthermore, the crane-and-basket method relies on the availability of the platform crane operator. A delay caused by the non-availability of a crane operator when needed results in down-time costs as well as an increase in the incidence of seasickness due to personnel spending an extended period time on a stationary but heaving/pitching/rolling transport vessel.

More recently, a gangway technique has been used wherein the free end of a ramp that is disposed on the oil rig is rotated toward and landed on a crew-transfer vessel. This technique is only suitable for use in relatively low sea states (e.g., sea state 2, etc.) since relatively higher sea states can cause substantial movement of the ramp. Such movement can present a safety risk to personnel that are using the ramp to transfer to an oil rig.

SUMMARY OF THE INVENTION

The present invention provides a crew transfer system that avoids some of the drawbacks and costs of the prior art. Among other advantages, the crew transfer system is useable to safely transfer personnel from a transfer vessel to stationary or quasi-stationary platform, such as an oil rig, in high sea states.

A crew transfer system in accordance with the illustrative embodiment of the present invention comprises a ramp, a first coupling, and a second coupling. The ramp is configured so that persons wishing to transfer between the vessel to the rig can simply walk across the ramp, even in high sea states.

In use, a first end of the ramp is coupled, for translation and rotation, to the transport vessel via the first coupling. The first coupling comprises a "first mechanism" that imparts three rotational degrees-of-freedom to the first end of the ramp. The three rotational degrees-of-freedom permit the ramp to (1) pitch about a pitch axis of the ramp; (2) roll about a roll axis of the ramp; and (3) yaw about a yaw axis of the ramp. In the illustrative embodiment, the first mechanism includes a bearing and several pins that provide these three rotational degrees-of-freedom.

In the illustrative embodiment, the system further comprises a guide that is disposed on the transport vessel. In the illustrative embodiment, the guide is implemented as two rails.

The first coupling further comprises a movable platform, wherein the first mechanism is disposed on the movable platform, and wherein the movable platform movably couples to the rails to provide the one translational degree of freedom to the first end of the ramp. In other words, the first end of the ramp is free to move towards the bow or stern of the transfer vessel.

The translational degree-of-freedom imparted by the moveable platform (and guide) prevents the first end of the ramp from moving laterally across the transfer vessel (i.e., prevents the end of the ramp from moving in the manner of a windshield wiper). The only translational motion of the first end of the ramp that is permitted by the system is along an axis that runs from bow to stern of the transfer vessel. In other words, the ramp is only permitted to move back and forth (i.e., a reciprocating movement) due to guide.

The second end of the ramp is rotationally coupled to the stationary platform (e.g., oil rig, etc.) via the second coupling. The second coupling comprises a second mechanism that imparts only two rotational degrees-of-freedom to the second end of the ramp. The two rotational degrees-of-freedom are (1) pitch about a pitch axis of the ramp and (2) yaw about a yaw axis of the ramp. In the illustrative embodiment, no rotation about the roll axis is permitted. Furthermore, no translational degrees-of-freedom are permitted.

In some embodiments, the ramp is stored on the transfer vessel and deployed when the vessel arrives at the rig. A portion of the second coupling, in particular, the second mechanism, is attached to a fixture (e.g., deployable staircase, etc.) on the oil rig. A winch lowers cables from the fixture, wherein the cables temporarily engage a coupling member that is disposed at the second end of the now-deployed ramp. The second end of ramp is then raised (via the engaged coupling member/cables) until the coupling member engages the second mechanism and is temporarily locked thereto. The cables are then winched out of engagement with the coupling member. Once engaged to the mechanism as described above, the ramp forms a temporary "bridge" between the transfer vessel and the oil rig.

In some embodiments, the ramp is foldable and/or collapsible.

DETAILED DESCRIPTION

In the illustrative embodiment, the crew transfer system is used to transfer personnel from a transfer vessel to an oil rig in the open ocean. It will be understood that the invention can be used to transfer personnel from a vessel to any stationary or quasi-stationary platform on the ocean. In conjunction with the present disclosure, those skilled in the art will be able to adapt the illustrative embodiment of the crew transfer system, as described below and depicted in the accompanying drawings, for use in coupling most transfer vessels to most stationary or quasi-stationary platforms to effect transfer of personnel.

Figure 1:
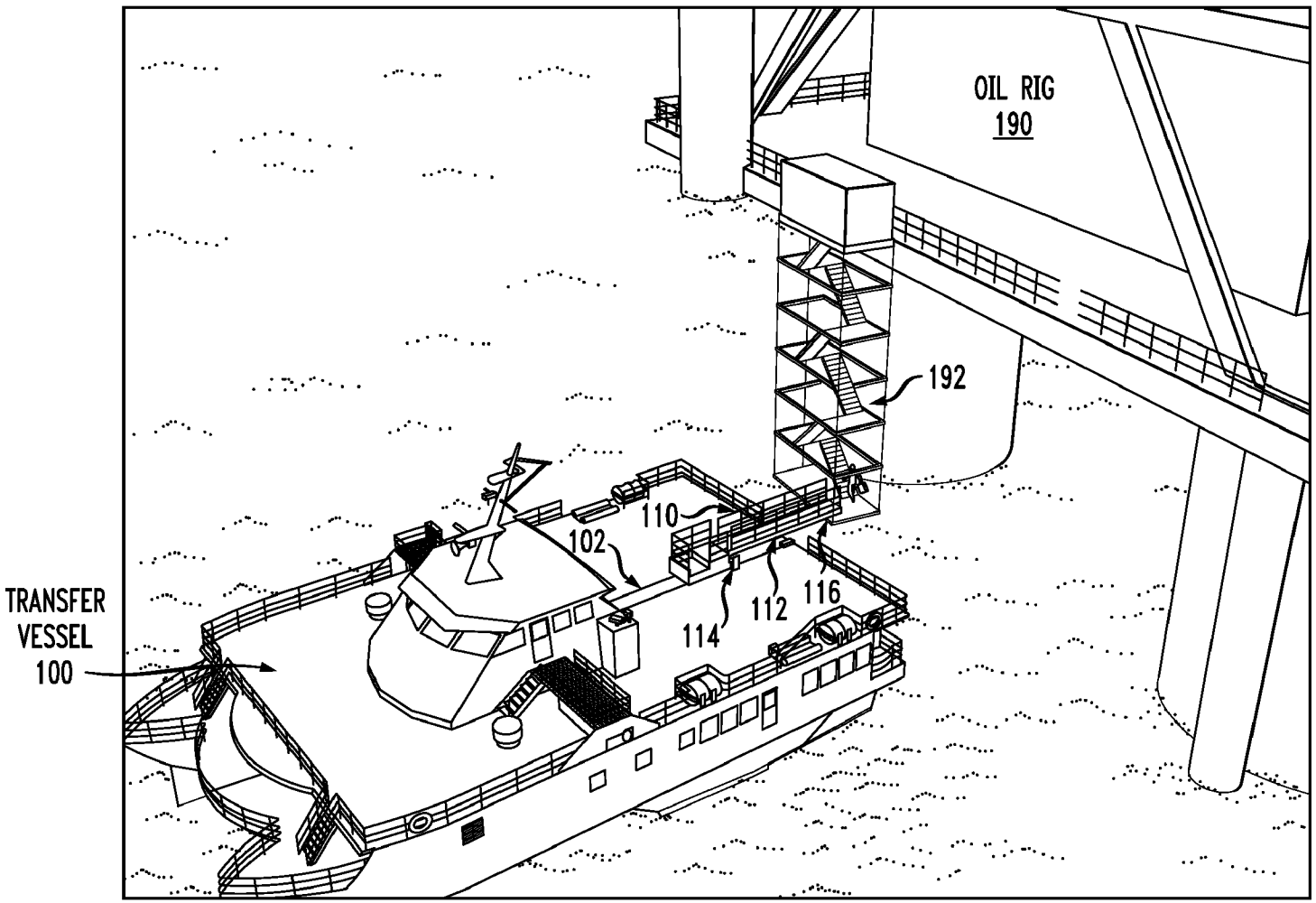
FIG. 1 depicts a crew transfer system in accordance with the illustrative embodiment of the present invention being used in conjunction with a transfer vessel and an oil rig.

Turning now to the Figures, FIG. 1 depicts a "bridge" being formed between transfer vessel 100 and oil rig 190 via a crew transfer system, generally indicated at "110," in accordance with the illustrative embodiment of the present invention. Crew transfer system 110 comprises ramp 112, a first coupling 114, and a second coupling 116 (details of the couplings are not shown in FIG. 1).

First coupling 114 couples a "first" or "vessel" end of ramp 112 to transfer vessel 100 and second coupling 116 couples a "second" or "rig" end of ramp 112 to oil rig 190. In the embodiment that is depicted in FIG. 1, second coupling 116 couples the rig end of the ramp to the bottom of stairs 192.

Figure 2B:
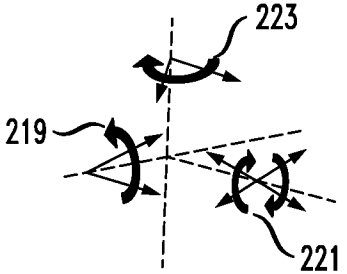
FIG. 2B depicts the three rotational axes about which rotation of the vessel-end of the ramp is free to occur.
Figure 2A:
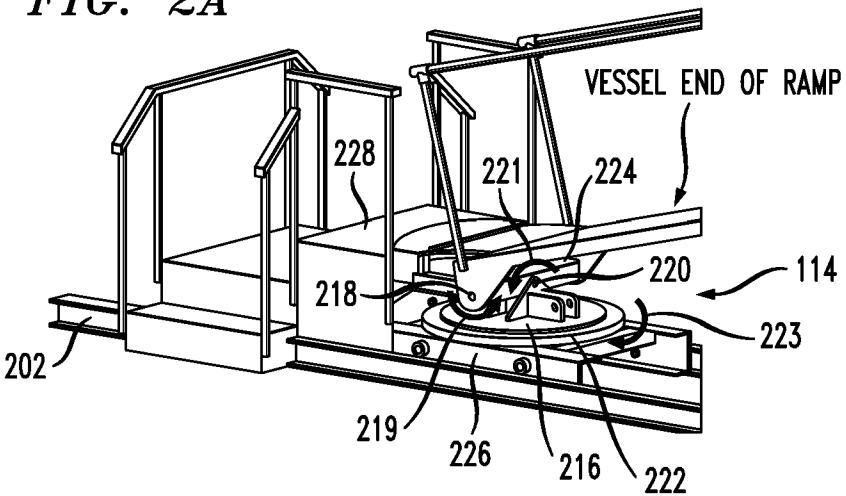
FIG. 2A depicts a perspective view of the vessel end of a ramp of the crew transfer system of FIG. 1. This Figure depicts an embodiment of a first coupling that provides three rotational degrees-of-freedom, as well as a "movable platform," which is capable of moving along guide rails to provide a single linear degree-of-freedom.

FIG. 2A depicts details of the vessel end of ramp 112 and first coupling 114 by which the ramp couples to transfer vessel 100. As depicted in FIG. 2, first coupling 114 comprises first mechanism 216 and movable platform 226.

First mechanism 216 comprises hinge pin 218, roll pin 220, and bearing 222. Roll pin 220 is disposed on bearing 222, and hinge pin 218 is disposed on member (e.g., bar, etc.) 224 that rotates about the roll pin. Referring now to FIG. 2B as well as FIG. 2A, hinge pin 218 enables the vessel-end of ramp 112 to pitch about pitch axis 219. Roll pin 220 enables the first end of ramp 112 to roll about roll axis 221. Bearing 222 enables the first end of ramp 112 to yaw about yaw axis 223. The various pins and bearings of first mechanism 216 are arranged, as shown, to provide three rotational degrees-of-freedom to the vessel-end of ramp 112.

In some embodiments, first mechanism 216 is arranged so that hinge pin 218 provides for up to +30 degrees of pitch (about axis 219), roll pin 220 provides for roll of up to −15 to +15 degrees (about axis 221), and bearing 222 provides for yaw of up to −30 to +30 degrees (about axis 223).

First mechanism 216 is disposed on movable platform 226. Platform/steps 228 are disposed on movable platform 226 as well. In the illustrative embodiment, movable platform 226 engages guide 102, which is disposed on transfer vessel 100 (see, FIG. 1). In the illustrative embodiment, guide 102 is implemented as I-beam-like guide rails 202, as depicted in FIG. 2.

Guide rails 202 are oriented along a bow-to-stern orientation (as shown for guide 102 in FIG. 1). In some embodiments, guide rails 202 are rigidly attached along their full length to transfer vessel 100. In some other embodiments, the guide rails are pivotably attached to the transfer vessel, wherein the attachment point is relatively closer to the bow of vessel 100.

Movable platform 226 and guide rails 202 enable the vessel-end of ramp 112 to translate in a single direction; namely, along rails 202. In this manner, first coupling 114 imparts three rotational degrees of freedom and one translational degree of freedom to the vessel end of ramp 112. Note that in the illustrative embodiment, platform/steps 228 translate with movable platform 226.

Figure 3:
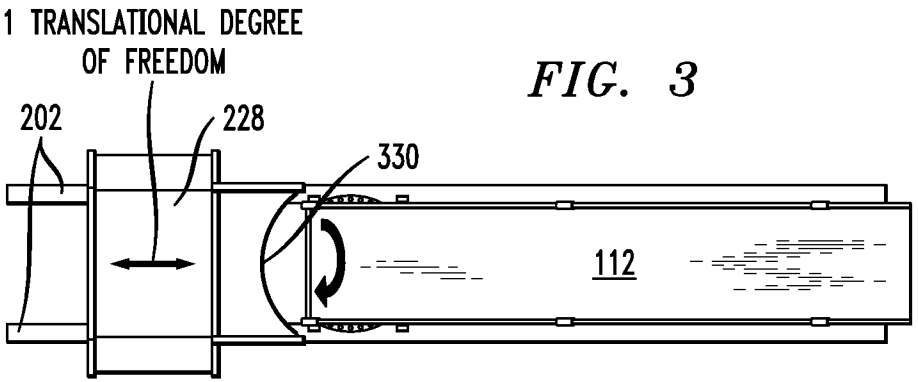
FIG. 3 depicts a top view of FIG. 2A. This Figure illustrates that in addition to the rotational degrees of freedom, the end of the ramp is has a single translational (linear) degree of freedom by virtue of the movable platform and guides.

FIG. 3 depicts a top view of the vessel end of ramp 112. Interface 330 between edge of platform/steps 228 and ramp 112 is curved (i.e., the respective adjacent edges of the platform/steps and the ramp are curved) to permit unfettered rotational movement (i.e. yaw) of vessel-end of ramp 112. The translational movement of the first end of ramp 112 along guide rails 202 is depicted.

Figure 4:
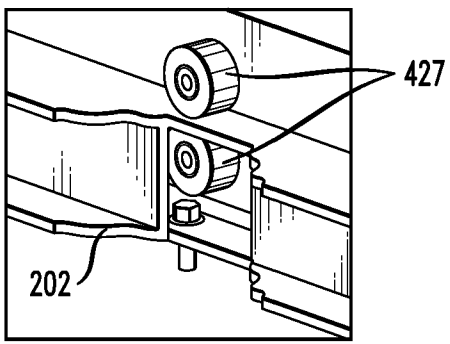
FIG. 4 depicts details of an embodiment of the movable platform, wherein the platform includes rollers that cooperate with guide rails on the transfer vessel.

FIG. 4 depicts details of an embodiment of movable platform 226 wherein the platform has rollers 427 that engage guide rails 202. This enables movable platform 226 to move along the guide rails as the second end of ramp 112 is raised to couple to (or lowered to decouple from) oil rig 190.

Figure 5:
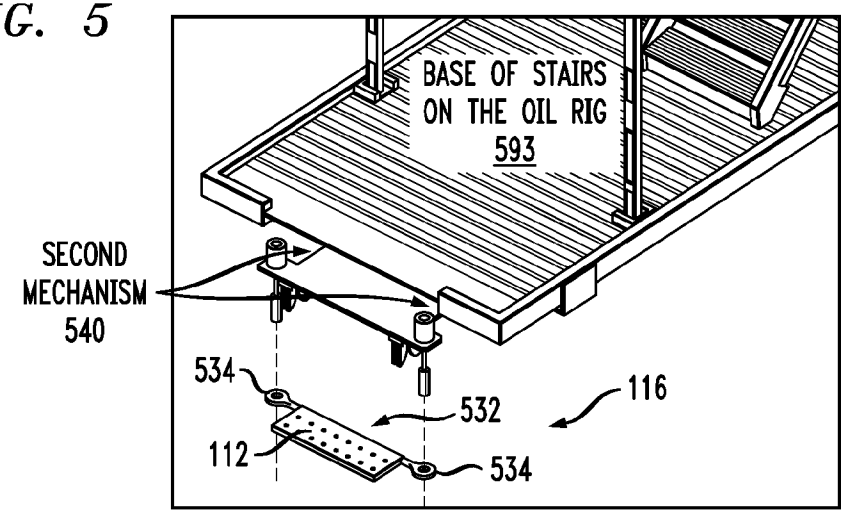
FIG. 5 depicts a coupling member that attaches to a second end of the ramp. The coupling member is received by a "second mechanism" of a second coupling, which is attached to an oil rig.

FIG. 5 depicts second coupling 116, whereby the ramp couples to base 593 of stairs 192 on oil rig 190. Second coupling 116 comprises coupling member 532 that depends from the "rig" end of ramp 112 and second mechanism 540 that depends from base 593 of stairs 192 on oil rig 190. Coupling member 532 includes two eyelets 534, which depend from opposite ends thereof. Second mechanism 540 includes cables and a locking mechanism, best depicted in FIGS. 6A-6C, 7, and 8A/8B.

As described in further detail below in conjunction with FIGS. 6A through 6C, 7, and 8A/8B, second mechanism 540 and coupling member 532 engage one another to couple ramp 112 to oil rig 190.

Figure 6B:
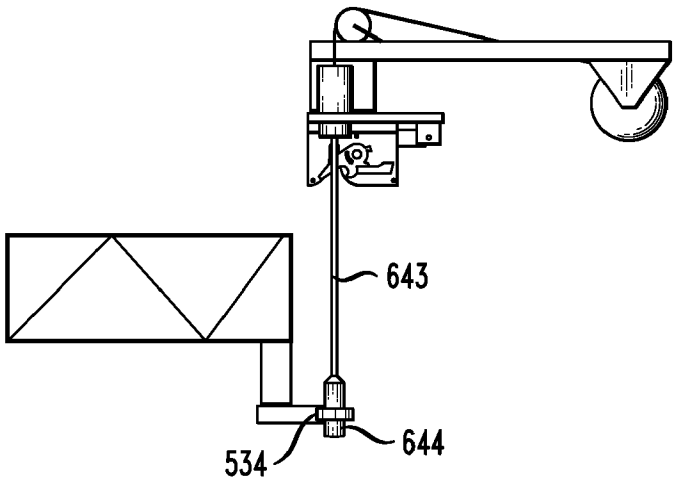
FIGS. 6A through 6C depict an operational sequence whereby the ramp is coupled to the oil rig.
Figure 6A:
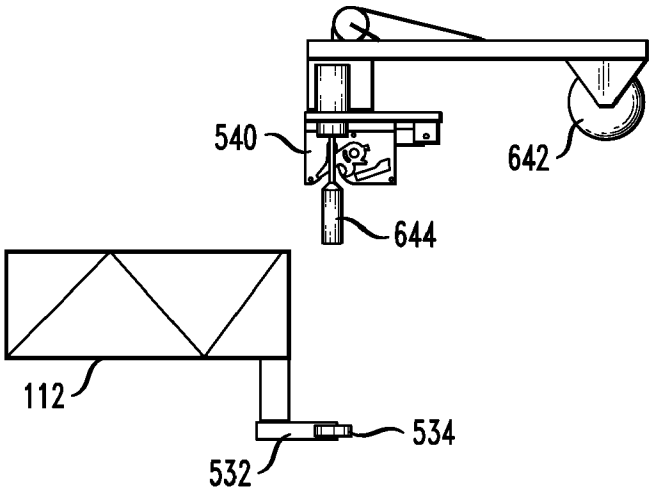
Figure 6C:
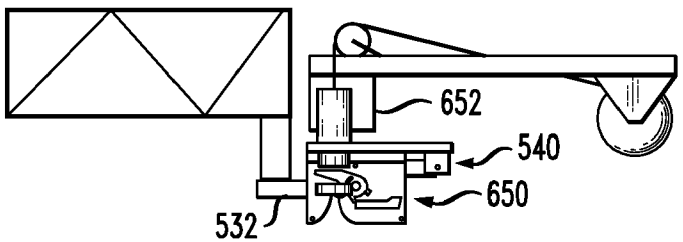

FIGS. 6A through 6C depict an operational sequence whereby the rig-end of ramp 112 is drawn into engagement with oil rig 190.

FIG. 6A depicts ramp 112 and second mechanism 540 (on oil rig 190) before coupling occurs. As depicted in FIG. 6A, coupling member 532 depends from the rig end of ramp 112. Coupling member 532 is positioned below second mechanism 440. In particular, eyelets 534 are positioned under cable ends 644. Such positioning is accomplished by movement of transfer vessel 100 and by movement of ramp 112 along guide 102 and, as necessary, rotation of bearing 222 (see FIG. 1).

Cables 643 are deployed by winch 642 to lower cable ends 644 toward coupling member 532. Eventually, cable ends 644 pass through eyelets 534 of coupling member 532, as depicted in FIG. 6B. This creates a temporary engagement between cables 643 and coupling member 532. Pins, etc., are deployed to couple cable ends 644 to eyelets 534. It is notable that operator involvement may be required to thread cable ends 644 through eyelets 534.

As depicted in FIG. 6C, the rig end of ramp 112 is raised, via the winch, toward second mechanism 540, which depends from base 593 of stairs 192. (See, e.g., FIGS. 1 and 5). Cable ends 644 continue to rise (into housing 652) until coupling member 532 is guided into locking mechanism 650 of second mechanism 540. At that point, cable ends 644 decouple from coupling member 532. In this fashion, coupling member 532 (and hence ramp 112) is temporarily but securely engaged to base 593 of stairs 192 of the oil rig.

Figure 7B:
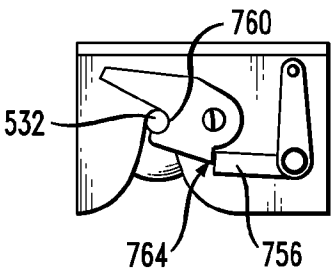
FIG. 7B depicts the locking mechanism after engagement.
Figure 7A:
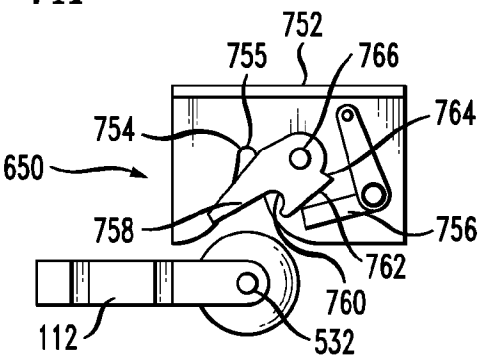
FIG. 7A depicts details of an embodiment of a locking mechanism (prior to engagement) whereby the coupling member temporarily engages the second mechanism to couple the second end of the ramp to the oil rig.

FIGS. 7A and 7B depict an embodiment of locking mechanism 650. FIG. 7A depicts locking mechanism 650 prior to engagement with coupling member 532 and FIG. 7B depicts mechanism 650 after engagement.

Referring now to FIG. 7A, mechanism 650 comprises plate 752, arm 756, and cam/latch 758. Plate 752 has a slot 754 for receiving coupling member 532. Arm 756 engages surface 762 of cam/latch 758. Curved surface 760 of cam/latch 758 receives coupling member 532. As coupling member 532 is winched upward, it enters slot 754 and also engages surface 760 of cam/latch 758. With continued upward movement of coupling member 532, cam/latch 758 rotates clockwise about pin 766. As cam/latch 758 rotates, arm 756 follows surface 762 toward notch 764.

With reference to FIG. 7B, upward movement of coupling member 532 ceases as it reaches top 755 of slot 754. In this position, cam/latch 758 has rotated sufficiently so that curved surface 760 supports coupling member 532 from below, such that coupling member 532 is restrained from "above" by top 755 of slot 754 and from "below" by curved surface 760 of cam/latch 758. Arm 756 has moved along surface 762 to engage notch 764, effectively locking coupling member 532 in this position. To decouple coupling member 532 from second mechanism 540, cable ends 644 are lowered to re-engage eyelets 534, and arm 756 is driven out of engagement (mechanism not depicted) with notch 764.

Figure 8A:
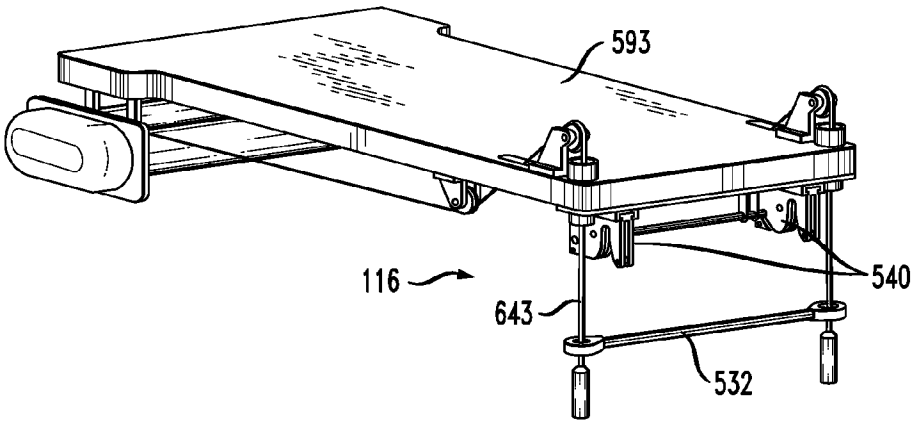
FIG. 8A depicts the second mechanism via a top perspective view of the base of the stairs on an oil rig.
Figure 8B:
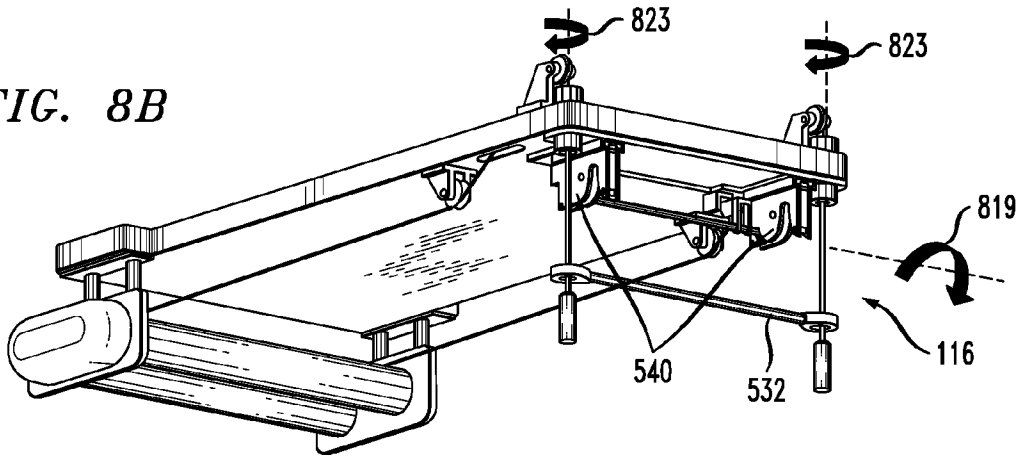
FIG. 8B depicts the second mechanism via a bottom perspective view of FIG. 8A.

FIGS. 8A and 8B depicts further detail of second coupling 116, including second mechanism 540 and coupling member 532 (shown sans ramp 112) via respective top and bottom perspective views of base 593 of (optionally) deployable stairs at oil rig 190. Cable 643 is shown as well.

Second mechanism 540 does not permit any translational movement of the rig end of ramp 112. Only rotational movement is permitted. But rather than permitting rotation in three directions like first mechanism 216 at the vessel-end of the ramp, second mechanism 540 limits rotational movements to two rotational directions. In particular, the second mechanism is configured to permit rotation about pitch axis 819 and about yaw axis 823; rotation about the roll axis is not permitted.

It is to be understood that the disclosure teaches just one example of the illustrative embodiment and that many variations of the invention can easily be devised by those skilled in the art after reading this disclosure and that the scope of the present invention is to be determined by the following claims.

What is claimed is:

1. A system for transferring personnel or material from a transport vessel to a stationary platform at sea, wherein the system comprises:

a ramp, wherein in use, a first end of the ramp is movably coupled to the transport vessel and a second end of the ramp is movably coupled to the stationary platform, and wherein the ramp includes a planar base that is suitably dimensioned and configured to enable personnel to walk thereon;

a first coupling, wherein:

(a) the first coupling movably couples together a first end of the ramp and the transport vessel;

(b) the first coupling provides three rotational degrees-of-freedom and one translational degree-of-freedom to the first end of the ramp; and a second coupling, wherein:

(a) the second coupling movably couples together a second end of the ramp and the stationary platform; and (b) the second coupling provides at least one rotational degree-of-freedom and no more than two rotational degrees-of-freedom and no translational degrees-of-freedom to the second end of the ramp.

2. The system of claim 1 wherein the three rotational degrees-of-freedom imparted by the first coupling comprise pitch about a pitch axis of the ramp, roll about a roll axis of the ramp, and yaw about a yaw axis of the ramp.

3. The system of claim 2 wherein the first coupling comprises a first mechanism, and wherein the first mechanism creates the three rotational degrees-of-freedom of the first end of the ramp.

4. The system of claim 3 wherein the first coupling further comprises a movable platform, wherein the first mechanism is disposed on the movable platform, and wherein the movable platform movably couples to the transfer vessel to provide the one translational degree of freedom to the first end of the ramp.

5. The system of claim 4 further comprising guides, wherein the guides are disposed on the transport vessel and the movable platform movably couples to the guides.

6. The system of claim 5 wherein the guides are immobilized on the transport vessel.

7. The system of claim 6 wherein the guides comprise rails.

8. The system of claim 5 wherein the movable platform comprises rollers, wherein the rollers contact the guides to enable the first coupling and the first end of the ramp to move along the guides, thereby providing the first translational degree-of-freedom to the first end of the ramp.

9. The system of claim 3 wherein the first mechanism comprises:

a bearing that enables the first end of the ramp to partially rotate about the yaw axis;

a roll pin, wherein the roll pin is operatively coupled to the bearing and enables the first end of the ramp to partially rotate about the roll axis; and a hinge pin, wherein the hinge pin is operatively coupled to the roll pin and enables the first end of the ramp to partially rotate about the pitch axis.

10. The system of claim 9 wherein the bearing permits a range of partial rotation of about +30 degrees to about −30 degrees relative to a reference axis at 0 degrees.

11. The system of claim 9 wherein the roll pin permits a range of partial rotation of about +15 degrees to about −15 degrees relative to a reference axis at 0 degrees.

12. The system of claim 9 wherein the hinge pin permits a range of partial rotation of about +30 degrees relative to a reference axis at 0 degrees.

13. The system of claim 1 wherein the at least one rotational degree-of-freedom imparted by the second coupling comprises pitch about a pitch axis of the ramp.

14. The system of claim 1 wherein the second coupling comprises a second mechanism, and wherein the second mechanism creates the at least one rotational degree-of-freedom of the second end of the ramp.

15. The system of claim 14 wherein the second mechanism is fixed to a structure that depends from the stationary platform.

16. The system of claim 15 wherein the second coupling further comprises a coupling member that is coupled to the second end of the ramp, and wherein in operation of the ramp, the coupling member couples to the second mechanism.

17. The system of claim 1 wherein the one translational degree-of-freedom provided by the first coupling prevents the first end of the ramp from moving laterally across a deck of the transfer vessel.

* * * * *